US012134498B2

(12) United States Patent
Bratsch

(10) Patent No.: US 12,134,498 B2
(45) Date of Patent: Nov. 5, 2024

(54) RESEALABLE CAN LID

(71) Applicant: XOLUTION TECHNOLOGY GmbH, Munich (DE)

(72) Inventor: Christian Bratsch, Salzburg (AT)

(73) Assignee: XOLUTION TECHNOLOGY GmbH, Munich (DE)

( * ) Notice: Subject to any disclaimer, the term of this patent is extended or adjusted under 35 U.S.C. 154(b) by 796 days.

(21) Appl. No.: 17/257,646

(22) PCT Filed: Jun. 26, 2019

(86) PCT No.: PCT/EP2019/067020
§ 371 (c)(1),
(2) Date: Jun. 8, 2021

(87) PCT Pub. No.: WO2020/007683
PCT Pub. Date: Jan. 9, 2020

(65) Prior Publication Data

US 2021/0292045 A1 Sep. 23, 2021

(30) Foreign Application Priority Data

Jul. 4, 2018 (EP) ..... 18181708

(51) Int. Cl.
*B65D 17/28* (2006.01)

(52) U.S. Cl.
CPC .. *B65D 17/4014* (2018.01); *B65D 2517/0011* (2013.01); *B65D 2517/0034* (2013.01)

(58) Field of Classification Search
CPC ..... B65D 17/4014; B65D 2517/0011; B65D 2517/0034; B65D 17/4012; B65D 17/401
(Continued)

(56) References Cited

U.S. PATENT DOCUMENTS 4,442,950 A 4/1984 Wilson
4,605,141 A 8/1986 Won
(Continued)

FOREIGN PATENT DOCUMENTS

CN 204979513 U 1/2016
EP 2409925 A1 1/2012
(Continued)

OTHER PUBLICATIONS

IP Australia; Examination Report No. 1 issued in patent family application 2019296969. Date of Report: Dec. 21, 2021.
(Continued)

*Primary Examiner* — Robert J Hicks
*Assistant Examiner* — Sanjidul Islam
(74) *Attorney, Agent, or Firm* — WARNER NORCROSS + JUDD LLP

(57) ABSTRACT

Aspects of the present disclosure are directed to a lid for a container. In one embodiment, the lid of the container includes a lid panel with a break-open region at least partially surrounded by a predetermined breaking line, and having a fastening member arranged on the lid panel. The lid further including a lever tab rotatably attached to the fastening member for breaking open the break-open region along the predetermined breaking line toward an underside of the lid panel and thereby providing a removal opening in the lid panel. In some embodiments, the lever tab includes a closure element attached to the lever tab, the closure element being adapted to be mountable to an upper side of the lid panel and sealingly surrounding the removal opening for closing the removal opening; and a locking element for locking the closure element when the removal opening is closed by the closure element.

9 Claims, 4 Drawing Sheets

(58) Field of Classification Search
USPC ..... 220/254.4, 906; 413/12, 14
See application file for complete search history.

(56) References Cited

U.S. PATENT DOCUMENTS

| | | | | |
|---|---|---|---|---|
| 4,720,022 | A | 1/1988 | Gomes | |
| 7,500,577 | B2 | 3/2009 | Wichelhaus | |
| 11,851,237 | B2 * | 12/2023 | Bratsch | B65D 17/4014 |
| 2003/0000952 | A1 * | 1/2003 | Dyren | B65D 17/4014 220/269 |
| 2007/0138178 | A1 | 6/2007 | Erickson | |
| 2011/0233227 | A1 | 9/2011 | Paris et al. | |
| 2012/0012586 | A1 | 1/2012 | Rinderer et al. | |
| 2012/0152949 | A1 | 6/2012 | Bratsch | |
| 2016/0023802 | A1 | 1/2016 | Brandtner | |

FOREIGN PATENT DOCUMENTS

| | | | | |
|---|---|---|---|---|
| GB | 2426970 | A | | 12/2006 |
| JP | 2006510553 | A | * | 12/2003 |
| JP | 2013503791 | A | * | 9/2010 |
| JP | 5505675 | | | 5/2014 |
| WO | 1993008087 | A1 | | 4/1993 |
| WO | 2007019592 | A1 | | 2/2007 |

OTHER PUBLICATIONS

IP Canada; Examination Report issued in counterpart application CA 3,104,770. Date of Report Mar. 1, 2022.
JPO; Examination Report No. 1 issued in corresponding application 2020570754. Date of Report: Feb. 28, 2022.
China National Intellectual Property Administration; Examination Report No. 1 issued in corresponding application 201980044345.8. Date of Report: Feb. 9, 2022.

* cited by examiner

RESEALABLE CAN LID

CROSS-REFERENCE TO RELATED APPLICATIONS

This application is a national stage filing based upon International PCT Application No. PCT/EP2019/067020, filed 26 Jun. 2019, which claims the benefit of priority to European application No. 18181708.1, filed 4 Jul. 2018.

FIELD OF INVENTION

The invention refers to a lid for a container, in particular for a beverage can, comprising: a lid panel having a break-open region at least partially surrounded by a predetermined breaking line, and having a fastening element arranged on the lid panel; and a lever tab rotatably attached to the fastening element for breaking open the break-open region along the predetermined breaking line in the direction of an underside of the lid panel and thereby providing a removal opening in the lid panel.

STATE OF THE ART

Lids of the type mentioned above are known from the state of the art and are used, for example, for beverage cans. The can is completely closed by the lid made of sheet material (aluminum) before it is opened for the first time. For opening, the lever tab is lifted by the user on one side, whereby the opposite side of the lever tab presses on the break-open region, which breaks open along the existing predetermined breaking line (usually provided as an indentation in the lid material) and is pressed into the can interior. This provides a removal opening (pouring opening, drinking opening). A disadvantage is that the removal opening cannot be re-closed after the can has been opened for the first time.

DESCRIPTION OF THE INVENTION

It is the object of the invention to overcome the mentioned disadvantage.

This object is solved by a lid for a container according to claim 1.

The lid for a container, in particular for a can, according to the invention comprises: a lid panel having a break-open region at least partially surrounded by a predetermined breaking line, and having a fastening element arranged on the lid panel; a lever tab rotatably attached to the fastening element for breaking open the break-open region along the predetermined breaking line in the direction of an underside of the lid panel and thus providing a removal opening in the lid panel; a closure element attached to the lever tab, the closure element being adapted to be placed against an upper side of the lid panel and sealingly enclosing the removal opening to close the removal opening; and a locking element for locking the closure element when the removal opening is closed by the closure element.

According to the invention, after the container has been opened for the first time, the lever tab is rotated around the fastening element and the closure element is arranged to rest on the lid panel, sealingly enclosing the removal opening, whereby closure (or re-closure) of the removal opening takes place. In order to also prevent unintentional opening (and the associated uncontrolled leakage of liquid), the closure element is locked with the locking element. In particular, this prevents the closure element from being pressed open by internal can pressure (for example, in the case of a carbonated beverage in the can).

The lid according to the invention can be further formed in that a break-up element for breaking-up the break-up region is arranged at a first end portion of the lever tab, and the closure element is arranged at a second end portion of the lever tab. Thereby, the first end portion and the second end portion may be provided opposite to each other with respect to the fastening element. Thus, the break-up element and the sealing closure element are spaced apart from each other and any deformation of the break-up element when the container is opened for the first time does not affect the closure element and its sealing action.

The lever tab may comprise a sheet material, in particular a sheet material containing aluminum, and a plastic material. The sheet material may be used, for example, for attachment to the fastening element. The break-up element may be formed of the sheet material to provide good strength for the break-up operation. Alternatively, the break-up element may be formed of the plastic material, preferably having a pressing portion protruding toward the underside with which the break-up region is locally contacted during the break-up operation to apply pressure thereto. The closure element can be made of the plastic material. In the manufacturing process, a sheet metal flap can be at least partially enclosed by the plastic material by means of injection molding.

According to another embodiment, the closure element may comprise a resilient seal for sealing the removal opening, wherein the resilient seal may be applied to the upper side of the lid panel sealingly surrounding the removal opening. In connection with the plastic material, the seal may be arranged on or partially within the plastic material. The sealing effect is improved by a resilient seal. This can be arranged in a simple manner on or in the plastic material, for example by gluing, welding or inserting/pressing it onto the underside of the closure element and/or a recess provided for this purpose.

In another embodiment, the lever tab may comprise a fastening tongue for fastening the lever tab to the fastening element. In connection with the sheet material of the lever tab, the fastening tongue may be formed of the sheet material.

According to another embodiment, the locking element may be arranged on the closure element or the closure element may comprise the locking element. The locking element is then rotated together with the closure element upon rotation of the fastening element about the closure element. The locking element may be formed by an injection molding process (assembly injection molding) in a form-fitting manner with the closure element (and yet movable in the closure element, in particular rotatable therein).

Another embodiment is that the locking element is provided in a displaceable or rotatable manner, and the locking element can comprise an actuating part for actuation by a user and a latch part coupled to the actuating part for locking the closure element by mechanical interaction of the latch part with the underside of the lid panel.

The locking element can be rotated about an axis at least partially parallel to the lid panel, whereby the latch part can be folded into mechanical contact with the underside of the lid panel or can be folded away to release the mechanical contact; or the locking element can be rotated about an axis at least partially perpendicular to the lid panel, whereby the latch part can be rotated into mechanical contact with the underside of the lid panel or can be rotated away to release the mechanical contact.

Furthermore, the actuating part of the locking element can be arranged on an upper side of the closure element and the latch part can be arranged on a underside of the closure element. The actuating part of the locking element is then easily accessible to a user from the top side.

According to another embodiment, the locking element can have a ventilation opening. This makes it possible to achieve a pressure reduction of the interior of the container after an initial opening of the container and a subsequent closing or re-closing of the removal opening with the closure element and before a renewed opening of the removal opening, thus preventing, for example, a rapid foaming or spouting of a carbonated beverage.

In this regard, the ventilation opening may be closable during a locking operation that can be performed with the locking element and may be releasable during an unlocking operation that can be performed with the locking element. In this way, pressure equalization between the interior and the exterior of the container can occur during the unlocking operation.

The ventilation opening may be provided in the latch part of the locking element. In particular, the mechanical contact between the latch part and the underside of the lid panel (inner side of the lid panel of the container) can thus provide a sealing locking of the ventilation opening in the locked state of the closure element.

In another embodiment, a seal enclosing the fastening element is provided on the underside of the closure element. In conjunction with a plastic material of the lever tab, the seal may be provided on the plastic material of the lever tab and/or formed integrally with the plastic material of the lever tab.

The invention further provides a container, in particular a can, wherein the container comprises a base body and a lid according to the invention or a lid according to one of the further embodiments.

The aforementioned further developments can be used individually or suitably combined with each other as claimed.

Further features and exemplary embodiments as well as advantages of the present invention are explained in more detail below with reference to the drawings. It is understood that the embodiments do not exhaust the scope of the present invention. It is further understood that some or all of the features described below may also be combined in other ways.

DRAWINGS

EMBODIMENTS

Figure 1A:
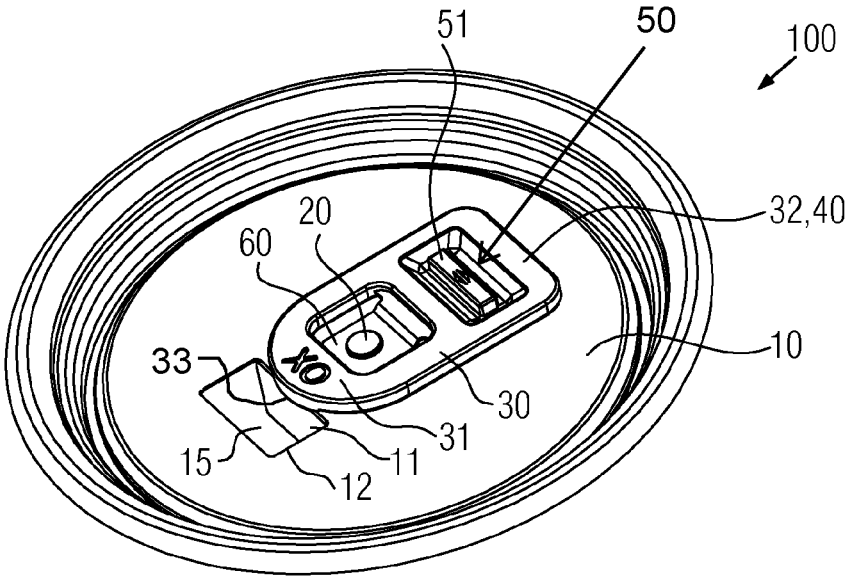
FIG. 1 shows a first embodiment of a lid according to the invention.
Figure 1B:
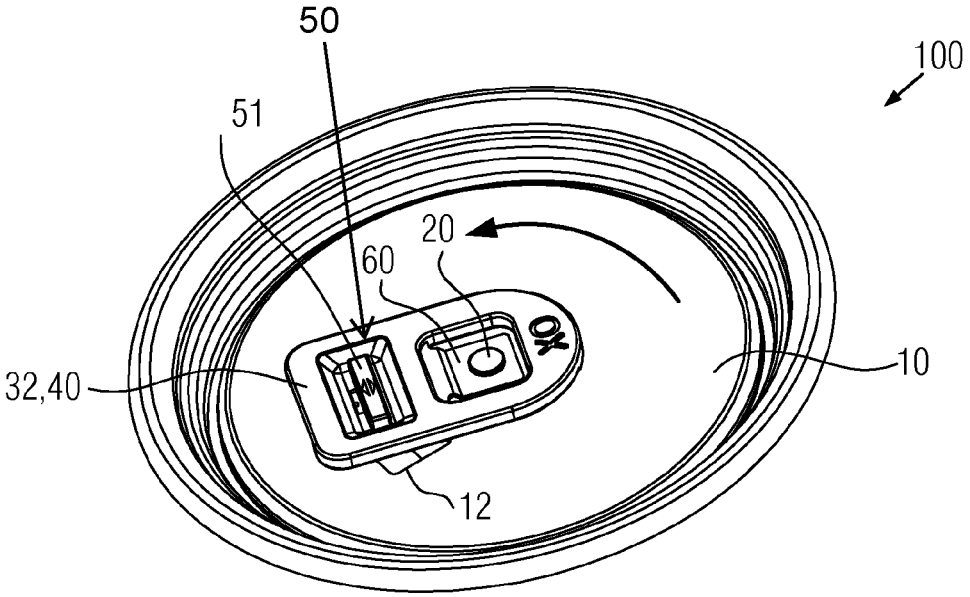
Figure 1C:
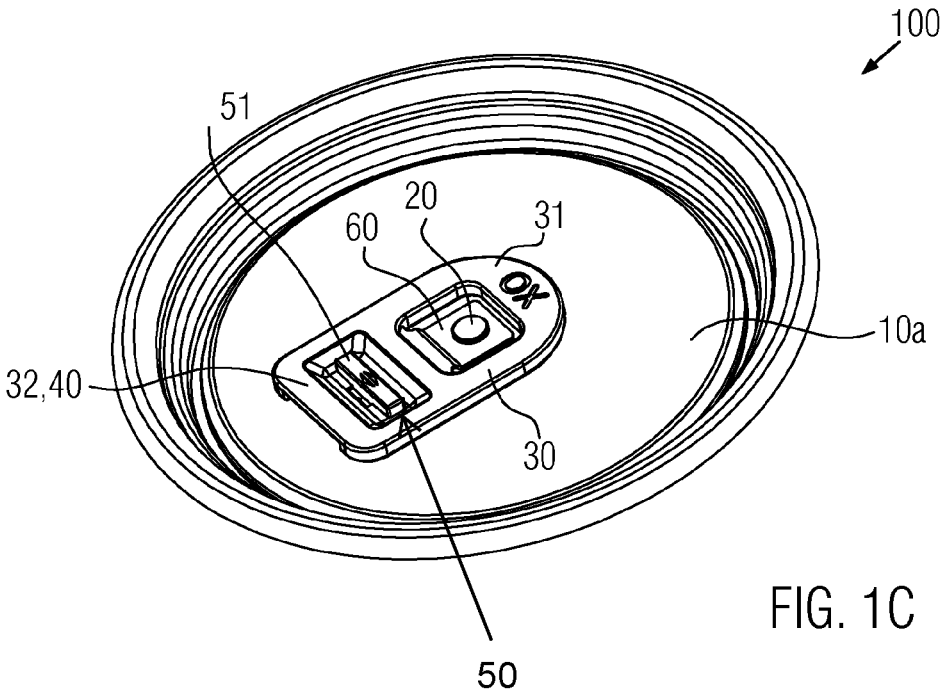
Figure 1D:
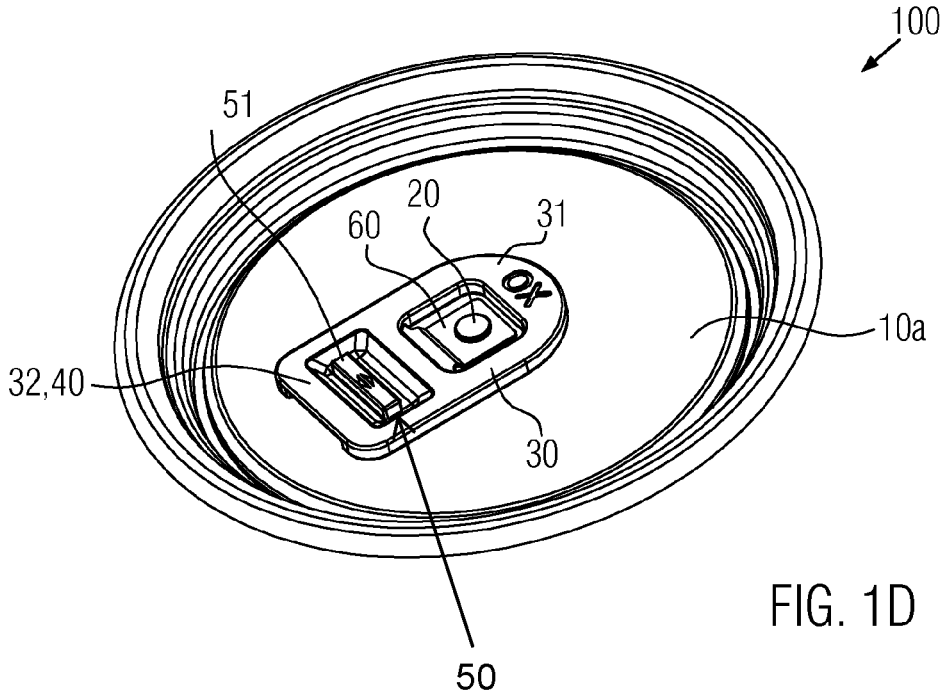
Figure 1E:
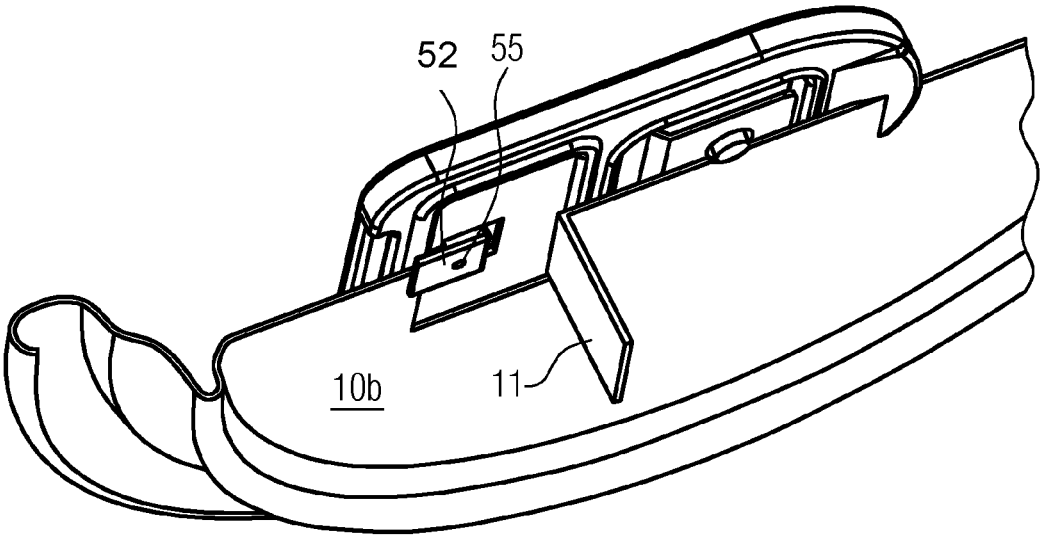
Figure 1F:
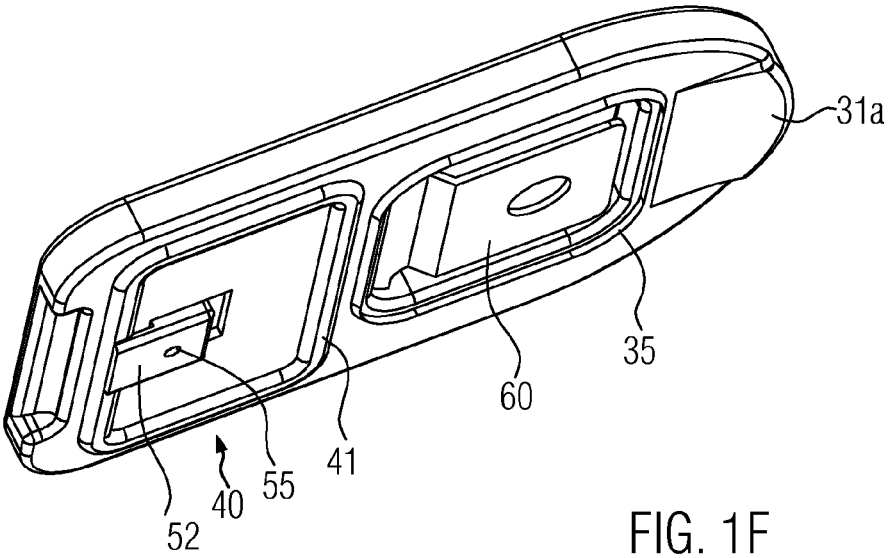

In the drawings, identical reference numerals denote identical or comparable elements.

FIG. 1A, B, C, D, E, F schematically illustrates a first embodiment of a lid 100 for a beverage can according to the invention.

In this first embodiment, the lid 100 according to the invention comprises a lid panel 10 made of an aluminum sheet with a break-open region 11. The break-open region 11 is partially surrounded by a predetermined breaking line 12. Furthermore, a fastening element 20 (rivet 20) is arranged on the lid panel 10 and a lever tab 30 rotatably attached to the fastening element 20 for breaking open the break-open region 11 along the predetermined breaking line 12 in the direction of a underside 10*b* of the lid panel 10, thereby providing a removal opening 15 in the lid panel 10. A closure element 40 is arranged on the lever tab, the closure element 40 being provided for closing the removal opening 15 on an upper side 10*a* of the lid panel 10. The closure element 40 seals the removal opening 15 abuttingly from the upper side 10*a* by sealingly enclosing the removal opening 15. Furthermore, a locking element 50 is provided for locking the closure element 40 when the removal opening 15 is closed by the closure element 40.

A break-up element 33 for breaking up the break-up region 11 is arranged at a first end portion of the lever tab 30, and the locking element 50 is disposed at a second end portion 32 of the lever tab 30. The first end portion 31 and the second end portion 32 are provided opposite to each other with respect to the fastening element 20.

After the container has been opened for the first time, the lever tab 30 is rotated about the fastening element 20 and the closure element 40 is arranged to rest on the lid panel and to sealingly enclose the removal opening 15, thereby causing closure (or re-closure) of the removal opening 15. Unintentional opening is prevented by locking the closure element 40 (or the lever tab 30) with the locking element 50. In particular, this prevents the closure element 40 from being pressed open by an internal pressure of the can (for example, in the case of a carbonated beverage in the can).

The lever tab 30 includes a sheet material, such as a sheet material including aluminum, and a plastic material. The sheet material is used to attach the lever tab 30 to the fastening element 20, and the lever tab includes a fastening tongue 60 for fastening the lever tab 30 to the fastening element 20. The fastening tongue 60 is formed of the sheet material. The break-up element 31 is formed of the plastic material, wherein a pressing portion protruding toward the underside exerts pressure on and breaks open the break-up region 11 during the break-up operation. The closure element 40 is also made of the plastic material. In the manufacturing process, a sheet metal flap is at least partially enclosed by the plastic material by means of injection molding.

The closure element 40 comprises a resilient seal 41 for sealing the removal opening 15, wherein the resilient seal on the upper side 10*a* of the lid panel 10 sealingly encloses the removal opening 15. A resilient seal improves the sealing effect. The seal 41 can be attached to the underside of the closure element 40, for example, by bonding or thermal welding, and/or can be pressed into a recess/groove provided for this purpose in the underside of the closure element.

The closure element 40 comprises the locking element 50. The locking element 50 is rotated about the fastening element 20 along with the closure element 40 (in conjunction with the lever tab 30) upon rotation of the closure element 40. The locking element 50 can be formed by an injection molding process (assembly injection molding) to be positively engaged with the closure element 40 and yet movable within the closure element.

The locking element 50 is provided to be slidable. The locking element 50 comprises an actuating part 51 for actuation/displacement by a user, and a latch part 52 coupled to the actuating part 51 for locking the closure element 40 by displacing the latch part beyond the edge of the removal opening 15 into mechanical contact with the underside 10*b* of the lid panel 10, thereby preventing both pushing open by a pressure from the underside and opening by a force acting from the outside (pulling upward on the lever tab in the region of the closure element 40).

The actuating part 51 of the locking element 50 is arranged on an upper side of the closure element 40, and the latch part 52 is arranged on an underside of the closure element 40. The actuating part 51 is accessible to a user from the top side.

The locking element comprises a ventilation opening 55. After the initial opening of the container and a subsequent closing or re-closing of the removal opening 15 with the locking element 50, and before the removal opening 15 is opened again, the interior of the container can thereby be depressurized via the ventilation opening 55 to prevent a carbonated beverage from rapidly foaming or spraying out. The ventilation opening 55 is closed during a locking operation with the locking element 50, and released during an unlocking operation. In this way, pressure equalization between the interior and the exterior of the container can occur during the unlocking operation.

In this embodiment, the ventilation opening 55 may be provided in the latch part 52 of the locking element 50. Due to the mechanical contact between the latch part 52 and the underside 10*b* of the lid panel 10 (inner side of the lid panel of the container), a sealing locking of the ventilation opening 55 can be provided when the closure element 40 is in the locked state.

A seal 35 enclosing the fastening element 20 may be provided on the underside of the lever tab 30. The seal may be provided on the plastic material of the lever tab 30 and/or formed integrally therewith. This seal 35 serves to keep contamination away from the underside of the lever tab 30 in the area of the rivet 20.

Figure 2:
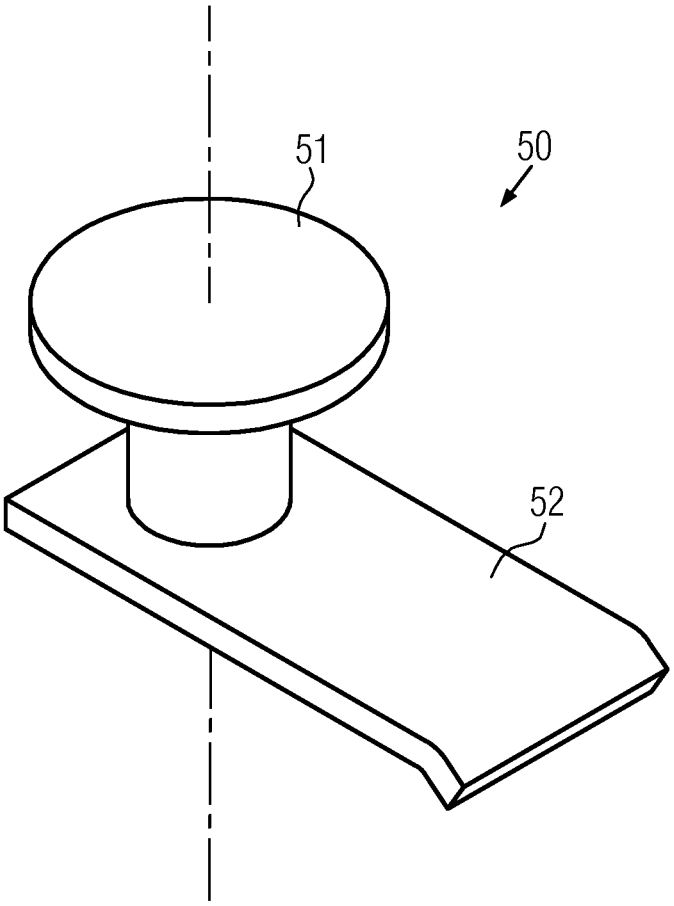
FIG. 2 shows a locking element for a second embodiment of a lid according to the invention.

FIG. 2 schematically illustrates a locking element for a second embodiment of a lid 100 for a beverage can according to the invention.

The difference to the first embodiment according to FIG. 1 is essentially that the locking element 50 has a different configuration. The locking element 50 is arranged in the closure element 40 so as to be rotatable about an axis extending perpendicularly to the lid panel 10, and comprises an actuating part 51 for actuation/rotation by a user and a latch part 52 coupled to the actuating part 51 for locking the closure element 40. By rotating the actuating part 51, the latch part 52 is rotated beyond the edge of the removal opening 15 into mechanical contact with the underside 10*b* of the lid panel 10, thereby locking the closure element 40.

Alternatively, the locking element 50 may be rotatably disposed in the closure element 40 about an axis parallel to the lid panel 10, and upon rotation of the actuating part 51, the latch part 52 is folded beyond the edge of the removal opening 15 into mechanical contact with the underside 10*b* of the lid panel 10.

The invention claimed is:

1. Lid for a container comprising:

a lid panel having a break-open region which is at least partially surrounded by a predetermined breaking line;

a fastening element which is arranged on the lid panel;

a lever tab rotatably attached to the fastening element and configured and arranged for breaking open the break-open region along the predetermined breaking line in the direction of an underside of the lid panel and thus providing a removal opening in the lid panel, the lever tab including a first end portion for impacting the break-open region of the lid panel and including a second end portion opposite of the first end portion;

a closure element attached to the lever tab, wherein the closure element is configured and arranged for closing the removal opening, the closure element comprising:

a resilient seal on an underside of the lever tab, the resilient seal fully surrounding the predetermined breaking line when the lever tab is rotated about the fastening element to a position in which the second end portion of the lever tab overlies the removal opening;

a latch part that is slidable in a first direction toward the first end portion of the lever tab and in a second direction toward the second portion of the lever tab; and a locking element movable in fixed relation with the latch part in the first direction and in the second direction, wherein the latch part abuts the underside of the lid panel when the latch part is moved in the second direction and releases from the underside of the lid panel when the latch part is moved in the first direction, and wherein the locking element is configured and arranged for locking the closure element when the removal opening is closed by the closure element by compressing the resilient seal against an upper surface of the lid panel when the latch part is moved in the second direction.

2. The lid according to claim 1, wherein a break-up element for breaking up the break-open region is arranged at the first end portion of the lever tab and the closure element is arranged at the second end portion of the lever tab.

3. The lid according to claim 1, wherein the lever tab includes a sheet material containing aluminum, and a plastic material.

4. The lid according to claim 1, wherein the locking element includes a ventilation opening.

5. The lid according to claim 4, wherein the ventilation opening is configured and arranged to be closable during a locking operation performable with the locking element and is releasable during an unlocking operation performable with the locking element.

6. The lid according to claim 3, the resilient seal being arranged on the plastic material of the lever tab and/or formed integrally with the plastic material of the lever tab.

7. The lid according to claim 3, wherein the seal is arranged at or partially in the plastic material.

8. Lid for a container comprising:

a lid panel having a break-open region which is at least partially surrounded by a predetermined breaking line;

a fastening element which is arranged on the lid panel;

a lever tab rotatably attached to the fastening element and configured and arranged for breaking open the break-open region along the predetermined breaking line in the direction of an underside of the lid panel and thus providing a removal opening in the lid panel;

a closure element attached to the lever tab, wherein the closure element is configured and arranged for closing the removal opening; and a locking element, wherein the locking element abuts the underside of the lid panel, wherein the locking element is configured and arranged for locking the closure element when the removal opening is closed by the closure element, wherein the locking element includes a ventilation opening, wherein the ventilation opening is provided in a latch part of the locking element.

9. A container comprising:

a base body; and a lid including:

a lid panel having a break-open region which is at least partially surrounded by a predetermined breaking line, a fastening element which is arranged on the lid panel, a lever tab rotatably attached to the fastening element and configured and arranged for breaking open the break-open region along the predetermined breaking line in the direction of an underside of the lid panel and thus providing a removal opening in the lid panel, the lever tab including a first end portion for impacting the break-open region of the lid panel and including a second end portion opposite of the first end portion, a closure element attached to the lever tab, wherein the closure element is configured and arranged for closing the removal opening, the closure element comprising:

a resilient seal on an underside of the lever tab, the resilient seal fully surrounding the predetermined breaking line when the lever tab is rotated to a position in which the second end portion overlies the removal opening, a latch part that is slidable in a first direction toward the first end portion and that is slidable in a second direction toward the second end portion, and a locking element movable in unison with the latch part in the first direction and the second direction, wherein the latch part abuts the underside of the lid panel when the latch part is moved in the second direction and releases from the underside of the lid panel when the latch part is moved in the first direction, and wherein the locking element is configured and arranged for locking the closure element when the removal opening is closed by the closure element by compressing the resilient seal against an upper surface of the lid panel when the latch part is moved in the second direction.

* * * * *